US009115967B2

(12) United States Patent
Elwell et al.

(10) Patent No.: US 9,115,967 B2
(45) Date of Patent: Aug. 25, 2015

(54) RADOME

(75) Inventors: Robert J. Elwell, Seven Hills, OH (US); Daniel G. Wall, Hudson, OH (US)

(73) Assignee: MACTek Corporation, Gates Mills, OH (US)

( * ) Notice: Subject to any disclaimer, the term of this patent is extended or adjusted under 35 U.S.C. 154(b) by 378 days.

(21) Appl. No.: 13/109,950

(22) Filed: May 17, 2011

(65) Prior Publication Data

US 2012/0075161 A1 Mar. 29, 2012

Related U.S. Application Data

(60) Provisional application No. 61/345,495, filed on May 17, 2010.

(51) Int. Cl.
*H01Q 1/42* (2006.01)
*F42B 10/46* (2006.01)

(52) U.S. Cl.
CPC ..... *F42B 10/46* (2013.01)

(58) Field of Classification Search
USPC ..... 343/872, 795, 985, 878, 873, 705
See application file for complete search history.

(56) References Cited

U.S. PATENT DOCUMENTS 4,353,769 A * 10/1982 Lee ..... 156/299
4,733,245 A * 3/1988 Mussler ..... 343/769
5,841,066 A * 11/1998 Bocherens ..... 174/2
6,091,375 A 7/2000 Goto et al.
6,107,976 A * 8/2000 Purinton ..... 343/872
8,130,167 B2 * 3/2012 Glabe et al. ..... 343/872
2002/0156757 A1 10/2002 Brown
2003/0043085 A1 * 3/2003 Park et al. ..... 343/770
2007/0252775 A1 * 11/2007 Munk et al. ..... 343/872
2008/0142238 A1 * 6/2008 Rawlings ..... 174/2
2009/0156118 A1 * 6/2009 Schadler ..... 455/25
2010/0103072 A1 * 4/2010 Wu et al. ..... 343/872
2010/0231441 A1 * 9/2010 Pruett et al. ..... 342/25 A
2011/0285604 A1 * 11/2011 Le Bayon et al. ..... 343/872

FOREIGN PATENT DOCUMENTS

EP 0359504 * 3/1990
EP 0557612 9/1993
WO 2008056123 5/2008

OTHER PUBLICATIONS

International Search Report and Written Opinion, Lee W. Young, PCT/US11/36890 ISA—US Sep. 27, 2011.

* cited by examiner

*Primary Examiner* — Thien M Le
(74) *Attorney, Agent, or Firm* — Thompson Hine LLP

(57) ABSTRACT

A radome comprises a substrate comprising a first material and an outer layer comprising a second material and positioned adjacent to the substrate. Methods for making and using the radome are also disclosed.

26 Claims, 6 Drawing Sheets

RADOME

CROSS-REFERENCE TO RELATED APPLICATIONS

This application claims the full benefit of and priority to U.S. Provisional Patent Application Ser. No. 61/345,495, filed on May 17, 2010 and entitled RADOME which is hereby incorporated by reference herein in its entirety.

TECHNICAL FIELD

This disclosure relates generally to structures for enclosing communication devices and more particularly to radomes for enclosing communication devices that transmit or receive electromagnetic radiation.

BRIEF DESCRIPTION OF THE DRAWINGS

It is believed that certain examples will be better understood from the following description taken in combination with the accompanying drawings in which.

SUMMARY

Figure 1:
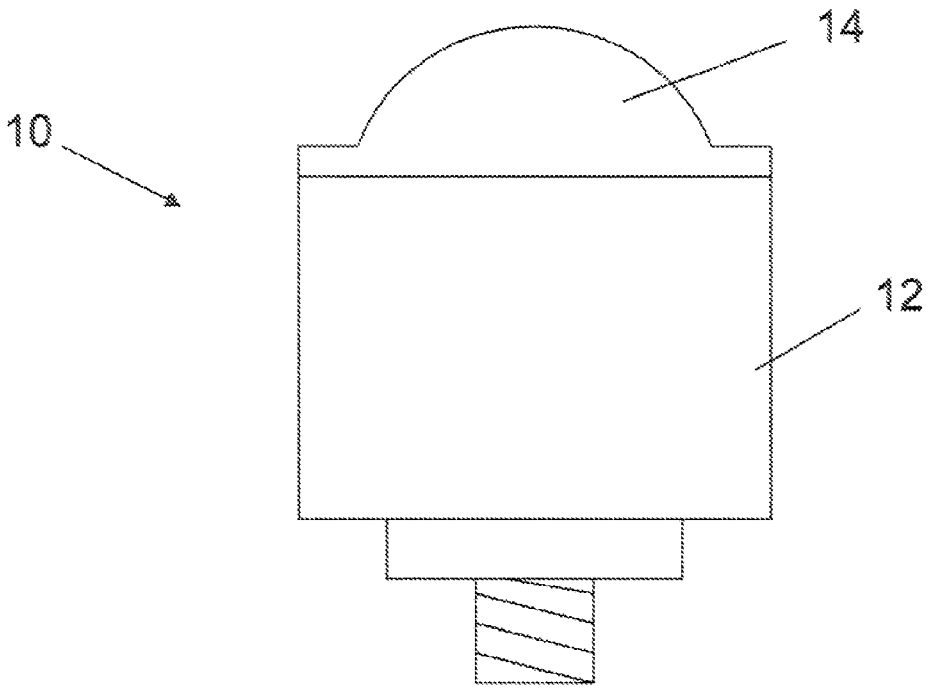
FIG. 1 is a schematic front view depicting a wireless communication device.

A radome can comprise a substrate that comprises a first material and an outer layer that comprises a second material and is positioned adjacent to the substrate. The first material of the radome can comprise a generally rigid polymeric material. The generally rigid polymeric material of the radome can comprise polyether ether ketone. The first material of the radome can further comprise a filler. The filler material of the radome can be selected from the group consisting of carbon black, talc, and glass, oxide. The second material of the radome can be an elastomeric material. The elastomeric material of the radome can comprises polyurethane. The elastomeric material of the radome can further comprises a material selected from the group consisting of 1,1'-(Ethane-1,2-diyl)bis[pentabromobenzene], carbon black, and antimony trioxide.

The outer layer of the radome can be coupled to the substrate. The outer layer of the radome can be over-molded onto the substrate. The substrate of the radome can include a recess and the outer layer of the radome can include a protrusion, where the protrusion is least partially positioned in the recess.

A wireless communication device can comprise a body arranged to include communication equipment and a radome coupled to the body. The radome can comprise a first portion that comprises a first material and a second portion that comprises a second material. The first portion of the wireless communication device can comprise a generally rigid polymeric material and the second portion of the wireless communication device can comprise a generally elastomeric material. The radome of the wireless communication device can be operational at a temperature of about −50 degrees Celsius and a temperature of about 85 degrees Celsius.

The radome of the wireless communication device can comply with a chemical compatibility standard of Approval Standard for Electrical Equipment for use in Hazardous (Classified) Locations General Requirements, Class Number 3600, November 1998 for at least one test chemical. The radome of the wireless communication device can comply with a chemical compatibility standard of Approval Standard for Electrical Equipment for use in Hazardous (Classified) Locations General Requirements, Class Number 3600, November 1998 for at least two test chemicals. The radome of the wireless communication device can comply with a chemical compatibility standard of ISA S12.0.01:1998 from the International Society of Automation. The radome of the wireless communication device can comply with a resistance to light standard of IEC 60079-0:2007, Fifth Edition from the International Electrotechnical Commission.

The radome of the wireless communication device can comply with an ultraviolet light exposure standard of UL 746C, Sixth Edition from Underwriters Laboratories Inc. The radome of the wireless communication device can comply with a flammability standard of UL 94, Fifth Edition from Underwriters Laboratories Inc. The radome of the wireless communication device can be classified as V-0 for a flammability standard of UL 94, Fifth Edition from Underwriters Laboratories Inc. The radome of the wireless communication device can comply with a surface resistivity standard of IEC 60079-0:2007, Fifth Edition from the International Electrotechnical Commission. The radome of the wireless communication device can comply with a resistance to impact standard of IEC 60079-0:2007, Fifth Edition from the International Electrotechnical Commission. The radome of the wireless communication device can have a dielectric breakdown voltage of about 1500 volts root mean square (VRMS).

DETAILED DESCRIPTION

The apparatus and methods disclosed and described in this document are described in detail with the views and examples of the included figures. Unless otherwise specified, like numbers in figures indicate references to the same or corresponding elements throughout the views of the figures. Those of ordinary skill in this art will recognize that modifications to disclosed and described components, elements, methods, materials, etc. can be made and may be desired for a specific application. In this disclosure, any identification of specific shapes, materials, techniques, and the like are either related to a specific example presented or are merely a general description of such a shape, material, technique, etc. Identifications of specific details are not intended to be and should not be construed as mandatory or limiting unless specifically designated as such. Selected examples of radomes and methods of their manufacture are hereinafter disclosed and described in detail with reference made to FIGS. 1 through 5.

An exemplary wireless communication device 10 is illustrated in FIG. 1. The communication device 10 can include a body 12 and a radome 14 that can be coupled to the body 12. The communication device 10 can be arranged to facilitate wireless communication between disparately located pieces of equipment, machines, apparatuses, appliances, computers, servers, and the like. Specifically, the communication device 10 can be used to wirelessly communicate data from one or more field devices such a temperature sensors, pressure sensors, flow sensors, or other types of sensors or detectors typically used to monitor or control a wide variety of industrial, chemical, or manufacturing processes.

In one example, the communication device 10 can be arranged so that when the communication device 10 is remotely deployed in the field, the communication device 10 can communicate with one or more field devices, a gateway, or both. The wireless communication device 10 can be placed in communication with equipment remotely located from the field to facilitate communications between a field device and the equipment. The communication device 10 can also be placed in communication with the equipment by, for example, directly wiring the wireless communication device 10 to the field device or connecting the wireless communication device 10 along a current loop associated with the equipment. In one example, a junction box can be used to connect the communication device 10 to a 4-20 mA or a 10-50 mA current loop (not shown) and thus place the communication device 10 in data or electrical communication with a field device or other equipment positioned along the current loop.

The body 12 of the wireless communication device 10 can enclose communication equipment such as a transmitter, an antenna, a receiver, a transponder, power circuitry, and the like capable of using, transmitting, or receiving electromagnetic signals. The radome 14 can be coupled to the body 12 and can be generally or at least partially transparent to electromagnetic signals, radio frequency signals, electromagnetic radiation, or other such communication signals. That is, the radome 14 can be arranged so that it either does not attenuate electromagnetic radiation, minimally attenuates electromagnetic radiation, or partially attenuates electromagnetic radiation transmitted or received by an antenna (not shown) that can be disposed within the radome 14 and connected to components disposed within the body 12 so as not to adversely affect communications. An example of an electromagnetic signal that can be transmitted through the radome 14 includes low-powered radio frequency signals conforming to the IEEE 802.15.4 (ZigBee™ specification), one of the IEEE 802.11.x (WiFi™), family of protocols, or other suitable wireless communication protocol. It will be understand that a wireless communication device 10 with a radome 14 can be arranged to conform to any number of wireless communication methods, protocols, or standards.

The radome 14 can be arranged to protect components internal to the wireless communication device 10, such as antennas, transmitters, etc. Such protection can enable the deployment of the wireless communication device 10 in any number of hazardous or industrial environments. For example, the radome 14 can provide protection from any number of adverse environmental conditions such as resisting degradation from a variety of chemicals, resisting damage from flames, resisting degradation due to ultraviolet light, remaining operational across a broad temperature range, surviving low-temperature impact, and dispersing static electricity. The radome 14 can provide such protections while allowing for the transmission of electromagnetic signals such as radio frequency radiation into and out of the wireless communication device 10. The radome 14 can be arranged to include certain properties and characteristics so as to meet an intrinsic safety rating for a given environment or be explosion proof under given conditions. In addition, the radome 14 can protect the antenna, transmitter, receiver, and other internal components from general weather conditions such as wind, rain, ice, sand, etc. and can further conceal the antenna, transmitter, receiver, and other internal components from public view.

Figure 2:
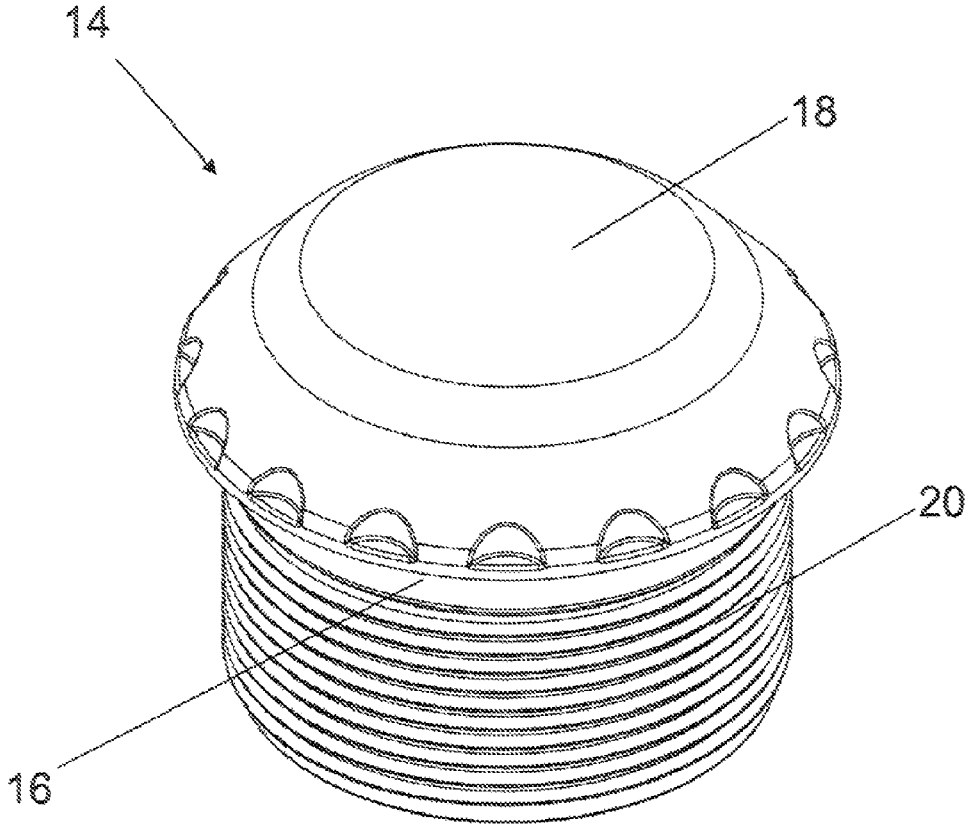
FIG. 2 is a perspective view depicting a radome for use with the wireless communication device of FIG. 1.
Figure 3:
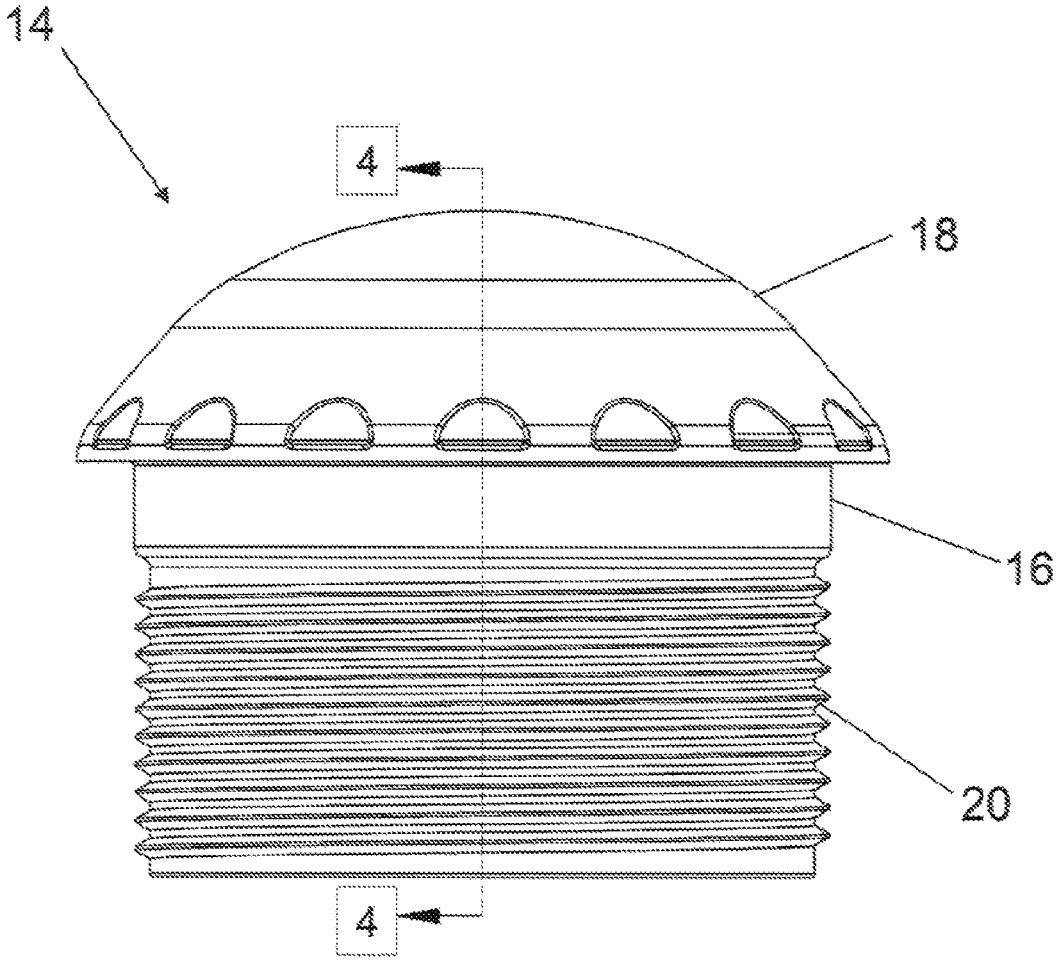
FIG. 3 is an elevation view depicting the radome of FIG. 2.
Figure 4:
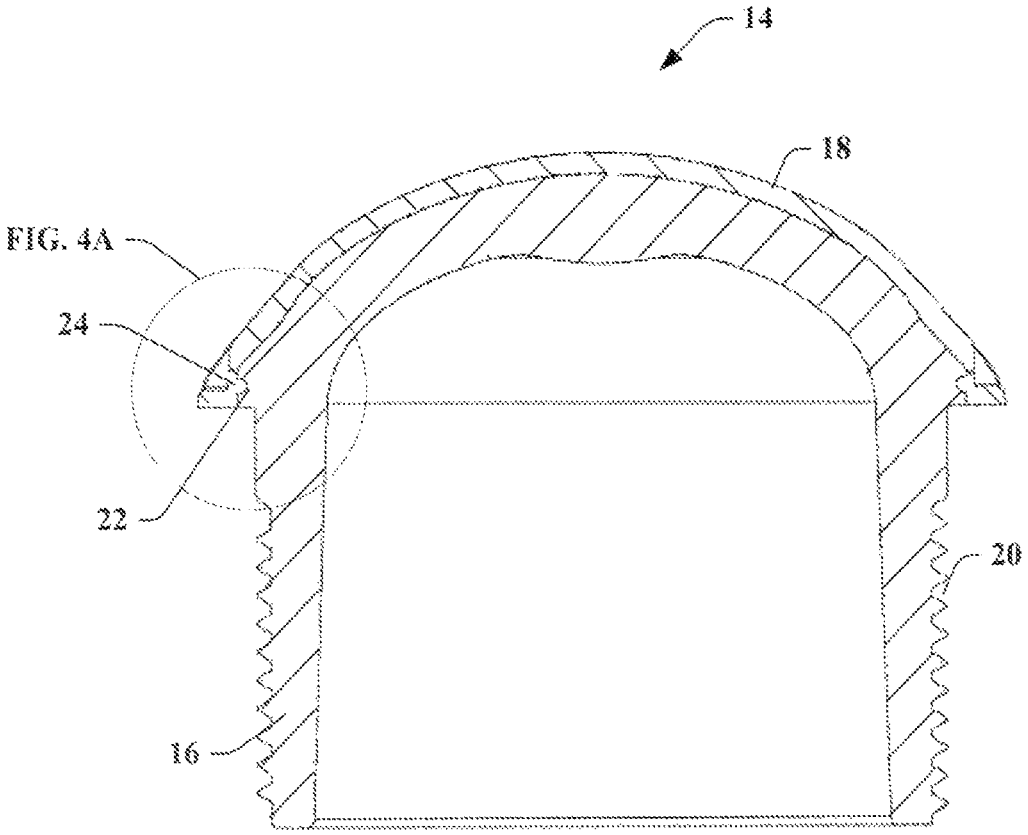
FIG. 4 is a cross-sectional view depicting the radome of FIG. 2 taken along the line 4-4 of FIG. 3.
Figure 4A:
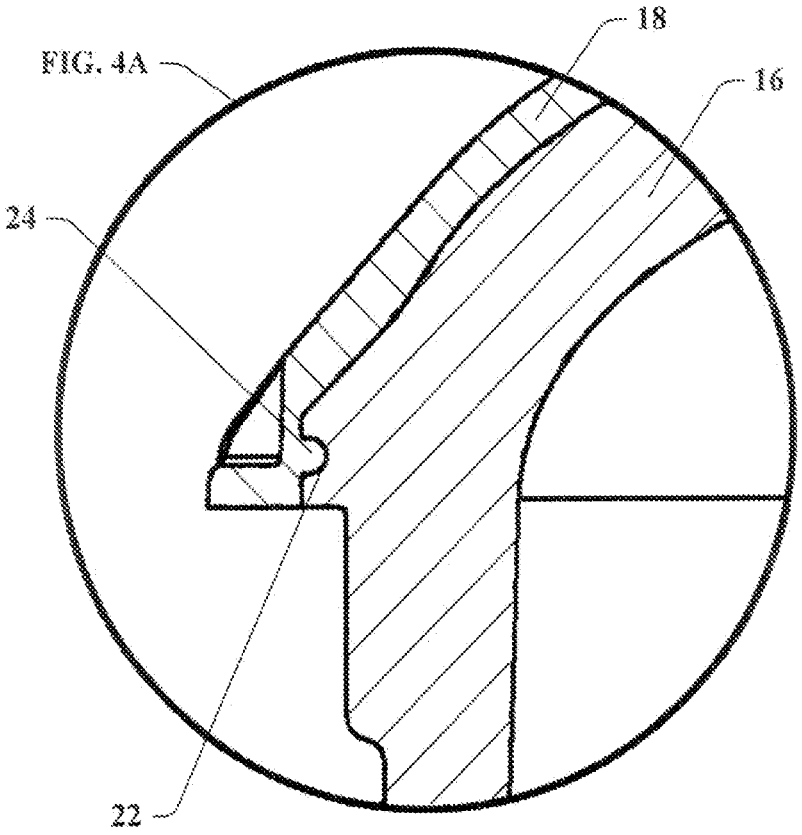
FIG. 4A is a detailed view depicting a portion of the radome of FIG. 2 as identified in FIG. 4.
Figure 5:
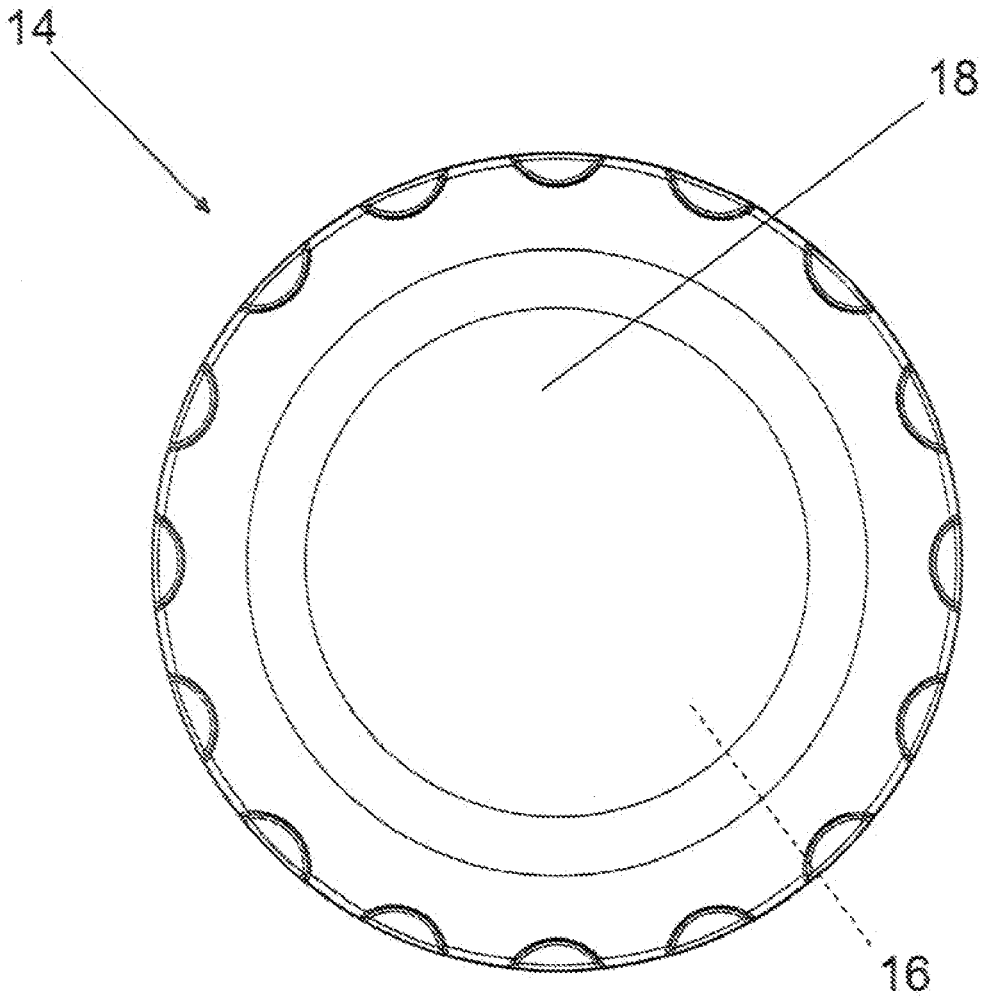
FIG. 5 is a plan view depicting the radome of FIG. 2.

The radome 14 is illustrated in greater detail in FIGS. 2-5. FIG. 2 is a perspective view of the radome 14, FIG. 3 is an elevation view of the radome 14, FIGS. 4 and 4A are cross-sectional view of the radome 14, and FIG. 5 is a plan view of the radome. As shown in these FIGS., the radome 14 can include a substrate 16, an outer layer 18 that can be coupled or positioned adjacent to the substrate 16, and a threaded portion 20. The substrate 16 can be arranged to provide for the structural integrity of the radome 14. In one example, the substrate 16 is shaped as a generally dome-shaped structure. The substrate 16 can be formed from a relatively rigid material so as to define the general dome shape of the radome 14 and provide structural integrity to withstand impact and internal pressure over a broad temperature range. The substrate 16 can also be arranged to be resistant to damage and degradation due to exposure to flames, chemicals, or ultraviolet (UV) radiation.

In one example, the substrate 16 can be fabricated from polyether ether ketone (PEEK). In another example, the substrate can be fabricated from a filled PEEK resin. The PEEK can be filled with a number of mixtures. In one example, filled PEEK can comprise "glass, oxide;" carbon black; or talc. In another example, filled PEEK can comprise from about 10 to about 30 percent "glass, oxide" by weight; from about 1 to about 5 percent carbon black by weight, and from about 5 to about 10 percent talc by weight.

In addition to providing structural integrity, PEEK or filled PEEK can also have a relatively low dielectric constant to minimize to the extent practicable any attenuation of radio signals though the radome 14. The threaded portion 20 of the substrate 16 can be formed as an integral portion of the substrate 16 so that the radome 14 can be coupled to a matching threaded portion (not shown) of the body 12 to form the wireless communication device 10.

As illustrated in FIG. 4, the outer layer 18 can be formed and coupled to or positioned adjacent to the substrate 16. As will be subsequently discussed, the outer layer 18 can be coupled to or positioned adjacent to the substrate 16 through a variety of techniques or methods.

The outer layer 18 can be formed or fabricated from a thermoplastic elastomer (TPE). For example, the outer layer 18 can be a styrenic block copolymer, a polyolefin blend, an elastomeric alloy such as a dynamically vulcanized thermoplastic, a thermoplastic polyurethane (TPU), a thermoplastic copolyester, a thermoplastic polyamide, or the like. In one example, the TPE can be arranged to have a hardness such that its durometer is in the range of about 50 to about 60. Such a TPE material can enhance the impact resistance of the radome 14. In one example, the TPE can be arranged to have electrical properties such that its surface resistance is in the range of about $10^6$ to about $10^9$ ohms (Ω), and the TPE can provide for static dissipation.

In another example, the TPE used to form or fabricate the outer layer 18 can be TPU. The composition of the TPU can be selected based on the desired properties for the radome 14. For example, the TPU can comprise a mixture of 1,1'-(Ethane-1,2-diyl)bis[pentabromobenzene], carbon black, and antimony trioxide. The TPU can comprise from about 10 to about 30 percent 1,1'-(Ethane-1,2-diyl)bis[pentabromobenzene] by weight, from about 1 to about 5 percent carbon black by weight, and from about 5 to about 10 percent antimony trioxide by weight. In other examples, the outer layer 18 can be fabricated from a polyester-based material that can be mainly derived from adipic acid esters, or the outer layer 18 can be fabricated from a polyether-based material that can be mainly derived from tetrahydrofuran (THF) ethers.

The outer layer 18 can be coupled or positioned adjacent to the substrate 16 through a variety of suitable techniques or methods. The substrate 16 can be arranged to accommodate a mechanical attachment of the outer layer 18 to the substrate 16. For example, as shown in FIGS. 4 and 4A, the substrate 16 can include one or more recesses 22, and the outer layer 18 can include one or more protrusions 24. As shown in this example, each protrusion 24 can at least partially engage an associated recess 22 and form a mechanical attachment that can secure or couple the outer layer 18 to the substrate 16. In another example, the outer layer 18 can be bonded to the substrate 16 by an adhesive or other such bonding agent (not shown). In such an example, a suitable mechanical preparation of the surface of the substrate 16, such as by texturing, scoring, abrading, or another suitable method, can enhance any mechanical or chemical bonding of the outer layer 18 to the substrate 16.

In yet another example, the outer layer 18 can be fabricated onto the surface of the substrate 16 and bonded to the substrate 16 during such a fabrication process. This is to say that the material used to fabricate the outer layer 18 can be applied to the substrate 16 while in molten form. As the material used to form the outer layer 18 cools and solidifies, a chemical or physical bond can formed between the outer layer 18 and the substrate 16 to secure or couple the outer layer 18 to the substrate 16.

Another example of a method of coupling the outer layer 18 to the substrate 16 is by over-molding. For example, the outer layer 18, when formed from TPE, can be over-molded onto the substrate 16. The TPE material of the outer layer 18 can be selected so that during the over-molding process, the TPE material of the outer layer 18 can contract or shrink during cooling to form a shrink fit between the outer layer 18 and the substrate 16. As previously described, a suitable mechanical preparation of the surface of the substrate 16, such as by texturing, scoring, abrading, or another suitable method, can enhance the mechanical bonding of the outer layer 18 to the substrate 16 when the outer layer 18 is shrink fit onto the substrate 16. The recess 22 and protrusion 24 described above can also be incorporated into an over molding processes. It will be understood that any number of suitable attachment or coupling mechanisms can be used to secure the outer layer 18 to the substrate 16.

By combining a substrate 16 composed of one material and an outer layer 18 composed of a second material to form the radome 14, each material can fulfill all or a subset of all of the total performance parameters desired for the radome 14. The combination of two materials can provide or enhance the ability of the radome 14 to meet or exceed performance characteristics of one or more of the parameters desired for a suitable radome 14. The substrate 16 or the outer layer 18, individually or in combination, can also meet one or more design criteria or industry standards desired or required for a specific application of the radome 14.

In one example, the radome 14 can be arranged to accommodate certain general environmental conditions, such as operation across a temperature range of about −50 degrees Celsius to about 85 degrees Celsius or across a humidity range of about 0 percent to about 100 percent. In other examples, the radome 14 can be arranged to comply with certain industry standards and protocols regarding safety and performance. For example, the radome 14 can be arranged so that its chemical compatibility can comply with "Approval Standard for Electrical Equipment for use in Hazardous (Classified) Locations General Requirements," Class Number 3600, November 1998 from FM Approvals, which is hereby incorporated by reference herein in its entirety.

The materials of the outer layer 18, the substrate 16, or both the outer layer 18 and the substrate 16 of the radome 14 can be arranged so that the radome 14 can resist chemical or physical changes due to solvent exposure as described in section 5.2 of "Approval Standard for Electrical Equipment for use in Hazardous (Classified) Locations General Requirements," Class Number 3600, November 1998 from FM Approvals. To determine whether the radome 14 complies with the chemical compatibility standards of said section 5.2, the radome 14 can be tested according to one of the protocols described in section 5.2. A protocol of section 5.2 includes a hardness measurement technique to examine whether a radome, such as the radome 14, meets the standard for chemical compatibility. An initial hardness measurement is taken and recorded for six test samples of the radome 14. Each test sample is exposed to the vapors of one specific test chemical. After the prescribed exposure to the vapors of the test chemical, a second hardness measurement is taken and recorded for comparison to the initial hardness measurement. Each test sample is exposed to one of the following test chemicals: 1) acetone (from the ketones chemical family), 2) gasoline (from the aliphatic hydrocarbons chemical family), 3) hexane (from the aliphatic hydrocarbons chemical family), 4) methanol (from the alcohol chemical family), 5) ethyl acetate (from the ester chemical family), and 6) acetic acid (from the acids chemical family).

The protocol for exposing a test sample to the vapors of one of the above-listed test chemicals is to place four fluid ounces per quart volume (or 120 cubic centimeters per liter) of the test chemical in a closed vessel and suspend the test sample above the liquid level. The test sample is subjected to the vapors of the test chemical for about 150 hours at a temperature of 20 degrees Celsius, plus or minus 5 degrees Celsius. After the 150 hours of exposure, the test sample is removed from the vessel and tested for hardness within an hour of its removal from the vessel. If any change in the hardness measurement of the test sample after exposure to the test chemical is not greater than 15 percent, as compared to the initial hardness measurement, the results of the test sample are considered satisfactory and the radome 14 is considered to comply with the standard with regard to the test chemical. It will be understood that the radome 14 can comply with the standard for all six of the above-listed test chemicals or can comply with the standard for only a subset of the above-listed test chemicals. In addition, the radome 14 can also be compliant with the chemical compatibility standards of other published standards such as, for example, ISA S12.0.01: 1998, from the International Society for Automation, which is hereby incorporated by reference herein in its entirety.

Although this disclosure describes certain testing protocols, procedures, and methods of certain published standards, it will be understood that fuller descriptions of such protocols or additional protocols are described and detailed in the respective published standards. Any description herein of a testing protocol, procedure, or method will not in anyway limit the testing protocols, procedures, or methods or the evaluation of a material as complying with published standards. It will be understood that a number of testing protocols, procedures, and methods described, detailed, or referenced in a published standard can be used to determine if a material or component complies with the published standard. It should also be noted that standards can also provide for partial compliance or specific exceptions. The testing protocols, procedures, and methods are included herein as non-limiting examples.

In another example, the radome 14 can be arranged so that its resistance to ultraviolet light complies with IEC 60079-0: 2007, Fifth Edition from the International Electrotechnical Commission or UL 746C, Sixth Edition, from Underwriters Laboratories Inc., both of which are hereby incorporated by reference herein in their entirety. The materials of the outer layer 18 or of the substrate 16, or both the outer layer 18 and the substrate 16 of the radome 14 can be arranged so that the radome 14 is resistant to light as described in sections 7.3 and 26.10 of IEC 60079-0:2007, Fifth Edition from the International Electrotechnical Commission. The testing protocol for determining whether the radome complies with said section includes preparing six test bars of standard size: 80±2 millimeters×10±0.2 millimeters×4±0.2 millimeters according to ISO 179-1:2000/Amd 1:2005 from the International Organization for Standardization. The test bars are made under the same conditions as the manufacturing of the outer layer 18, the substrate 16, or both the outer layer 18 and the substrate 16.

The testing protocol is conducted in accordance with ISO 4892-2:2006 from the International Organization for Standards, in an exposure chamber using a xenon lamp and a sunlight simulating filter system, and at a black panel temperature of 65±3 degrees Celsius. The exposure time is at least 1,000 hours. Whether the radome 14 complies with the standard is determined by testing the impact bending strength of the test bars in accordance with ISO 179 referenced above. If the impact bending strength following exposure in the case of an impact on the exposed side is at least 50 percent of the corresponding value measured for unexposed test bars, the radome 14 complies with the standard. If the material impact bending strength cannot be determined prior to exposure because no rupture has occurred, then not more than three of the exposed test bars are allowed to break for the radome 14 to comply with the standard.

The materials of the outer layer 18 or of the substrate 16, or both the outer layer 18 and the substrate 16 of the radome 14 can be arranged so that the radome 14 complies with the ultraviolet light exposure standards of sections 25, 57.1, and 57.2 of UL 746C. Said sections test for degradation of materials exposed to ultraviolet weathering by comparing flammability and physical properties of test specimens before and after exposure to ultraviolet light. An example of a testing protocol for UL 746C includes using either of the following sources for ultraviolet radiation: 1) a xenon-arc lamp in accordance with ASTM G151-00, "Standard Practice for Exposing Nonmetallic Materials in Accelerated Test Devices That Use Laboratory Light Sources," from ASTM International and ASTM G155-00, "Standard Practice for Operating Xenon Arc Light Apparatus for Exposure of Nonmetallic Materials" from ASTM International where the spectral power distribution of the xenon lamp conforms to the requirement in Table 1 in ASTM G155-00 for a xenon lamp with daylight filters, using a programmed cycle of 120 minutes consisting of a 102-minute light exposure and an 18-minute exposure to water spray with light, and the apparatus operates with a spectral irradiance of 0.35 $W/m^2$ nm at 340 nm and a black-panel temperature of 63±3 degrees Celsius; or 2) a twin enclosed carbon-arc lamp in accordance with ASTM G151-00, and ASTM G153-00, "Standard Practice for Operating Enclosed Carbon Arc Light Apparatus for Exposure of Nonmetallic Materials" from ASTM International, where the spectral power distribution of the enclosed carbon-arc shall conform to the requirements in ASTM G153-00 for enclosed carbon-arc lamp with borosilicate glass globes, using a programmed cycle of 20 minutes consisting of a 17-minute light exposure and a 3-minute exposure to water spray with light shall be used, and the apparatus shall operate with a black-panel temperature of 63±3 degrees Celsius.

Test specimens are mounted vertically on the inside of a cylinder in the ultraviolet-light apparatus, with the width of the specimens facing the arcs, and so that they do not touch each other. Two sets of test specimens are exposed. For twin enclosed carbon-arc, one set is exposed for a total of 360 hours and the second set for a total of 720 hours. For xenon-arc, one set is exposed for a total of 500 hours and the second set for a total of 1000 hours. After the test exposure, the test specimens are removed from the test apparatus, examined for signs of deterioration such as crazing or cracking, and retained under conditions of ambient room temperature and atmospheric pressure for not less than 16 hours and not more than 96 hours, before being subjected to flammability and physical testing. For comparative purposes, specimens that have not been exposed to ultraviolet light and water are to be subjected to these tests at the same time that the final exposed specimens are tested.

Tensile and flexural strength tests are conducted on test specimens that are generally no thicker than the corresponding thickness of the radome 14. The results of tensile, Charpy or Izod Impact testing of standard specimens in the nominal 4 millimeter thickness can be considered representative of the testing of a reduced thickness provided the non-impact testing of the reduced thickness complies with the requirements of section 25 of UL 746C. Flammability tests are conducted on standard specimens that are representative of the minimum thickness for each unique flammability classification. If a material is to be considered in a range of colors, flammability and physical property specimens representing the natural pigments, the highest level of organic pigments, the highest level of inorganic pigments, and any color pigments known to affect weatherability characteristics are to be tested and considered representative of the entire color range.

Equipment for impact testing can comprise a cast aluminum base; two steel-rod impact weights weighing 0.91 kilograms and 1.82 kilograms; a hardened-steel round-nose impactor weighing 3.64 kilograms and with a radius of 8 millimeters; and a slotted guide tube 1.0 meters in length. The impact weights slide, and also have inch-pound (joule) graduations in 0.23 J (2 inch-lb) increments. A bracket fixes the tube in a vertical position by attaching it to the base and also holds the hand knob that is a pivot-arm alignment for the impactor approximately 50 millimeters under the tube. This equipment is mounted firmly to a rigid table or bench.

Each determination of impact resistance can use 20 test specimens. One at a time, the test specimens are placed so that they are centered over the opening in the specimen support. All test specimens for a given material must be of the same general thickness. The impactor foot is lowered to come in contact with the top surface of the test specimen. To conduct the test, the weight, either 0.91 kilograms or 1.82 kilograms, as needed, is raised to the height to give the desired impact value and released so that it drops on the impactor. The test specimen is examined for a crack, break, or split appearing on the side opposite the contact area. If the first sample results in a crack, split, or break, the next test specimen is impacted at a level one increment lower. If the sample passes this test, the next test specimen is to be tested at the next increment higher than the first test specimen. Data is analyzed using the Up-and-Down Design (Staircase) Method described in the National Bureau of Standards Handbook 91, Experimental Statistics, to estimate the mean value before and after the ultraviolet light exposure.

The Estimated Standard Deviation shall be calculated to determine if the chosen increments are within the proper range. An increment equal to the standard deviation is the most desirable. This deviation is determined from the formula: $S=1.6\times d[B/N-(A/N)^2]+0.47\ d$, where d is the increment of height in millimeters. The Mean Failure Height (h) is determined using the formula: $h=h_o+d\ (A/N)\pm 0.5d$, where $h_o$ is the lowest height that impact failure occurred. The Mean Failure Energy (MFE) is determined from the formula:

MFE=hwf, where w is the value of the weight in kilograms and f equals $9.80665\times10^{-3}$ (a factor for conversion to joules). The value of MFE before and after ultraviolet light exposure is used to determine compliance with the impact property requirements.

The minimum property retention limitations after ultraviolet conditioning for base test specimens and any colors under consideration are that: 1) the flammability shall not be reduced as a result of 720 hours of twin enclosed carbon-arc (ASTM G151 and ASTM G153) or 1000 hours of xenon-arc (ASTM G151 and ASTM G155) weatherometer conditioning; and 2) for tensile strength, flexibility strength, Izod impact, or Charpy impact testing, the average physical property values after ultraviolet conditioning shall not be less than 70 percent of the unconditioned value.

The materials of the outer layer 18 or of the substrate 16, or both the outer layer 18 and the substrate 16 of the radome 14 can be arranged so that the radome 14 complies with the flammability standards of UL 94, Fifth Edition, which is hereby incorporated by reference herein in its entirety. For example, to test whether the radome 14 complies with a flame rating standard of UL 94 or whether a radome 14 would be classified as V-0 by UL 94, the following test protocol can be conducted. All specimens are cut from sheet material, or are cast or injection, compression, transfer or pultrusion molded to the necessary form. After any cutting operation, care is taken to remove all dust and any particles from the surface, and cut edges are to have a smooth finish. Specimens can be prepared that are 125±5 millimeters in length and 13±0.5 millimeters in width, with the specimens representing the minimum thickness and the and maximum thickness. The minimum thickness to be tested will be 0.025 millieters and the maximum thickness will be 13 millieters. Specimens in intermediate thicknesses are also provided and tested if the results obtained on the minimum or maximum thickness indicate inconsistent test results. Differences in intermediate thicknesses are not to exceed increments of 3.2 millieters. The edges of the specimens are to be smooth with a radius on the corners is not to exceed 1.3 millieters.

If a material is to be considered in a range of colors, densities, melt flows, or reinforcement, specimens representing these ranges are also to be provided. Specimens in the natural and in the most heavily pigmented light and dark colors are to be provided and considered representative of the color range if the test results are essentially the same. In addition, a set of specimens is to be provided in the heaviest organic pigment loading, unless the most heavily pigmented light and dark colors include the highest organic pigment level. When certain color pigments are known to affect flammability characteristics, they are also to be provided. Specimens in the extremes of the densities, melt flows and reinforcement contents are to be provided and considered representative of the range, if the test results are essentially the same. If the burning characteristics are not essentially the same for all specimens representing the range, evaluation is to be limited only to the materials in the densities, melt flows, and reinforcement contents tested, or additional specimens in intermediate densities, melt flows, and reinforcement contents are to be provided for testing.

Two sets of five specimens are preconditioned in accordance with ASTM D618-05 (ISO 291:2005) at 23±2 degrees Celsius and 50±5 percent relative humidity for a minimum of 48 hours. Two sets of five specimens are preconditioned in an air-circulating oven for 168 hours at 70±2 degrees Celsius and cooled in the desiccator for at least 4 hours at room temperature prior to testing. Each specimen is clamped at the upper 6 millieters of the specimen, with the longitudinal axis positioned vertically, so that the lower end of the specimen is 300±10 millieters above a horizontal layer of not more than 0.08 grams of absorbent 100 percent cotton thinned to approximately 50×50 millieters and a maximum thickness of 6 millieters. The burner is adjusted to confirm to the nominal 50 W test flame. That is, the methane gas supply to the burner is adjusted to produce a gas flow rate of 105±5 milliliters per minute with a back pressure less than 10 millieters water per ASTM D5207-03 from ASTM International. The burner is placed remote from the specimen and ignited. The burner is adjusted to produce a blue flame 20±1 millieters high. The flame is obtained by adjusting the gas supply and the air ports of the burner until an approximate 20±1 millieters yellow-tipped blue flame is produced. The air supply is increased until the yellow tip disappears. The height of the flame is measured again and adjusted it if necessary.

The burner is made to approach the specimen horizontally from the wide face at a rate of approximately 300 millieters per second. The flame is applied centrally to the middle point of the bottom edge of the specimen so that the top of the burner is 10±1 millieters below the point of the lower end of the specimen, and maintained at that distance for 10±0.5 seconds starting when the flame is fully positioned under the specimen, moving the burner as necessary in response to any changes in the length or position of the specimen. If the specimen shrinks, distorts, or melts, the point of application shall remain in contact with the major portion of the specimen. If the specimen drips material during the flame application, the burner is tilted to an angle of 45±5 degrees perpendicular to the wide face of the specimen and withdrawn just sufficiently from beneath the specimen to prevent material from dropping into the barrel of the burner while maintaining the 10±1 millieters spacing between the center of the top of the burner and the remaining major portion of the damaged specimen, ignoring any strings of molten material.

After the application of the flame to the specimen for 10±0.5 seconds, the burner is immediately withdrawn at a rate of approximately 300 millieters per second, to a distance at least 150 millieters away from the specimen and the afterflame time ($t_1$) is recorded to the nearest second. As soon as afterflaming of the specimen ceases, even if the burner has not been withdrawn to the full 150 millieters distance from the specimen, the burner is immediately placed under the specimen again maintain the burner at a distance of 10±1 millieters from the remaining major portion of the specimen for an additional 10±0.5 seconds, while the burner is moved clear of dropping material as necessary. After application of the flame to the specimen, the burner is immediately removed at a rate of approximately 300 millieters per second to a distance of at least 150 millieters from the specimen and simultaneously the afterflame time ($t_2$) and the afterglow time ($t_3$) are recorded to the nearest second.

The radome 14 will be classified as a V-0 material if appropriate conditions are met such as the afterflame time for each individual specimen ($t_1$ or $t_2$) is less than or equal to 10 seconds; total afterflame time for any condition set ($t_1$ plus $t_2$ for the 5 specimens) is less than or equal to 50 seconds; afterflame plus afterglow time for each individual specimen after the second flame application ($t_2$ plus $t_3$) is less than or equal to 30 seconds; the afterflame or afterglow of any specimen does not burn up to the holding clamp; and cotton indicator did not ignite by flaming particles or drops.

In another example, the materials of the outer layer 18 or of the substrate 16, or both the outer layer 18 and the substrate 16 of the radome 14 can be arranged so that the surface resistivity of the radome 14 complies with IEC 60079-0:2007, Fifth Edition. The materials of the outer layer 18 or the substrate 16 or both of the radome 14 can be arranged so that the radome 14 has a surface resistivity as described in sections 7.4.2 and 26.13 of IEC 60079-0:2007, Fifth Edition. In one example, the radome 14 can comply with IEC 60079-0:2007, Fifth Edition if its surface resistance is less than or equal to $10^9$ ohms when tested according to the following testing protocol. The radome 14 is prepared for testing by painting two parallel electrodes on its surface to create a test sample. The electrodes will be painted using a conducting paint with a solvent that has no significant effect on the surface resistance. The test sample is cleaned with distilled water, then with isopropyl alcohol (or any other solvent that can be mixed with water and will not affect the material of the test piece or the electrodes), and once more with distilled water. The test sample is dried. Untouched by bare hands, the test sample is conditioned for at least 24 hours at 23±2 degrees Celsius and 50±5 percent relative humidity. The test is conducted under the same ambient conditions. A direct voltage is applied for 65±5 seconds between the electrodes at 500±10 volts. During the test, the voltage is held sufficiently steady so that the charging current due to voltage fluctuation will be negligible compared with the current flowing through the test sample. The surface resistance is the quotient of the direct voltage applied at the electrodes to the total current flowing between them. When the surface resistance is less than or equal to $10^9$ ohms, the radome 14 complies with IEC 60079-0; 2007, Fifth Edition.

In another example, the materials of the outer layer 18 or of the substrate 16, or both the outer layer 18 and the substrate 16 of the radome 14 can be arranged so that the dielectric breakdown voltage of the radome 14 is about 1500 volts root mean square (VRMS).

In another example, the materials of the outer layer 18 or of the substrate 16, or both the outer layer 18 and the substrate 16 of the radome 14 can be arranged so that the resistance to impact of the radome 14 complies with IEC 60079-0:2007, Fifth Edition. The materials of the outer layer 18 or the substrate 16 or both of the radome 14 can be arranged so that the radome 14 has a resistance to impact as described in section 26.4.2 of IEC 60079-0:2007, Fifth Edition. The resistance to impact can be testing using the following testing protocol. The radome 14 can have a test mass of 1 kilogram dropped onto it from a vertical height of h. The height h can range from about 0.7 meters to about 2 meters. The mass is fitted with an impact head made of hardened steel in the form of a hemisphere of 25 millieters diameter. Before each test, the surface of the impact head is checked to insure good condition. The resistance to impact test is conducted on a radome 14 that is completely assembled and ready for use. The test is conducted on at least two samples, at two separate places on each sample. The radome 14 is mounted on a steel base so that the direction of the impact is normal to the surface being tested if it is flat, or normal to the tangent to the surface at the point of impact if it is not flat. The base can have a mass of at least 20 kilograms or be rigidly fixed to or inserted in the floor. The test is conducted at an ambient temperature of 20±5 degrees Celsius. If the radome 14 maintains its structural integrity, it complies with IEC 60079-0:2007, Fifth Edition.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art.

What is claimed is:

1. A radome, comprising:

a substrate including a first material that includes a generally rigid polymeric material, wherein the generally rigid polymeric material includes polyether ether ketone; and an outer layer including a second material and positioned adjacent to the substrate.

2. The radome of claim 1, wherein the first material further comprises includes a filler.

3. The radome of claim 2, wherein the filler is selected from the group consisting of carbon black, talc, and glass, oxide.

4. The radome of claim 3, wherein the second material is an elastomeric material.

5. The radome of claim 4, wherein the elastomeric material comprises polyurethane.

6. The radome of claim 5, wherein the elastomeric material further comprises a material selected from the group consisting of 1,1'-(Ethane-1,2-diyl)bis[pentabromobenzene], carbon black, and antimony trioxide.

7. The radome of claim 1 wherein the second material is an elastomeric material.

8. The radome of claim 7 wherein the elastomeric material comprises polyurethane.

9. The radome of claim 8 wherein the elastomeric material further comprises a material selected from the group consisting of 1,1'-(Ethane-1,2-diyl)bis[pentabromobenzene], carbon black, and antimony trioxide.

10. The radome of claim 1 wherein the outer layer is coupled to the substrate.

11. The radome of claim 10, wherein the outer layer is over-molded onto the substrate.

12. The radome of claim 10, wherein the substrate includes a recess and the outer layer includes a protrusion that is at least partially positioned in the recess.

13. The radome of claim 1, wherein the radome is operational at a temperature of about −50 degrees Celsius and a temperature of about 85 degrees Celsius, and wherein the radome has a dielectric breakdown voltage of about 1500 volts root mean square (VRMS).

14. The radome of claim 13, wherein the radome is constructed so as to comply with:

a chemical compatibility standard of Approval Standard for Electrical Equipment for use in Hazardous (Classified) Locations General Requirements, Class Number 3600, November 1998 for at least one test chemical;

a chemical compatibility standard of ISA S12.0.01:1998;

a resistance to light standard of IEC 60079-0:2007, Fifth Edition;

an ultraviolet light exposure standard of UL 746C, Sixth Edition;

a flammability standard of UL 94, Fifth Edition;

a surface resistivity standard of IEC 60079-0:2007, Fifth Edition; and a resistance to impact standard of IEC 60079-0:2007, Fifth Edition; and wherein the radome is classified as V-0 for a flammability standard of UL 94, Fifth Edition.

15. The radome of claim 1, wherein the radome is constructed so as to comply with:

a chemical compatibility standard of Approval Standard for Electrical Equipment for use in Hazardous (Classified) Locations General Requirements, Class Number 3600, November 1998 for at least one test chemical;

a chemical compatibility standard of ISA S12.0.01:1998;
a resistance to light standard of IEC 60079-0:2007, Fifth Edition;
an ultraviolet light exposure standard of UL 746C, Sixth Edition;
a flammability standard of UL 94, Fifth Edition;
a surface resistivity standard of IEC 60079-0:2007, Fifth Edition; and
a resistance to impact standard of IEC 60079-0:2007, Fifth Edition; and
wherein the radome is classified as V-0 for a flammability standard of UL 94, Fifth Edition.

16. A wireless communication device comprising:
a body arranged to include communication equipment; and
a radome coupled to the body, the radome including
a first portion including a first material that includes a generally rigid polymeric material and
a second portion including a second material that includes a generally elastomeric material, and
wherein the radome is operational at a temperature of about −50 degrees Celsius and a temperature of about 85 degrees Celsius.

17. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome complies with a chemical compatibility standard of Approval Standard for Electrical Equipment for use in Hazardous (Classified) Locations General Requirements, Class Number 3600, November 1998 for at least one test chemical.

18. The wireless communication device of claim 17, wherein the radome complies with a chemical compatibility standard of Approval Standard for Electrical Equipment for use in Hazardous (Classified) Locations General Requirements, Class Number 3600, November 1998 for at least two test chemicals.

19. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome complies with a chemical compatibility standard of ISA S12.0.01:1998.

20. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome complies with a resistance to light standard of IEC 60079-0:2007, Fifth Edition.

21. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome complies with an ultraviolet light exposure standard of UL 746C, Sixth Edition.

22. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome complies with a flammability standard of UL 94, Fifth Edition.

23. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome is classified as V-0 for a flammability standard of UL 94, Fifth Edition.

24. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome complies with a surface resistivity standard of IEC 60079-0:2007, Fifth Edition.

25. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome complies with a resistance to impact standard of IEC 60079-0:2007, Fifth Edition.

26. A wireless communication device comprising:
a body arranged to include communication equipment; and
a radome coupled to the body, the radome including
a first portion including a first material that includes a generally rigid polymeric material that includes polyether ether ketone and
a second portion including a second material that includes a generally elastomeric material, and
wherein the radome has a dielectric breakdown voltage of about 1500 volts root mean square (VRMS).

* * * * *